US008678331B1

(12) United States Patent
Butler

(10) Patent No.: US 8,678,331 B1
(45) Date of Patent: Mar. 25, 2014

(54) DECK DRAINAGE SYSTEM BRACKETS

(76) Inventor: David Lee Butler, Woodstock, GA (US)

( * ) Notice: Subject to any disclaimer, the term of this patent is extended or adjusted under 35 U.S.C. 154(b) by 0 days.

(21) Appl. No.: 13/342,257

(22) Filed: Jan. 3, 2012

(51) Int. Cl.

| | |
|---|---|
| ***F16M 11/00*** | (2006.01) |
| *A47H 1/10* | (2006.01) |
| *E04B 1/70* | (2006.01) |
| *E04F 17/00* | (2006.01) |

(52) U.S. Cl.
USPC ..... 248/201; 248/317; 52/302.1

(58) Field of Classification Search
USPC ..... 52/24, 302.1, 506.05, 698, 712, 713; 248/58, 74.4, 200, 201, 220.1, 228.5, 248/229.14, 229.24, 231.61, 316.6
See application file for complete search history.

(56) References Cited

U.S. PATENT DOCUMENTS

| | | | | |
|---|---|---|---|---|
| 872,018 | A | 11/1907 | Repp | |
| 3,468,509 | A * | 9/1969 | Foltz | 248/316.6 |
| 4,039,131 | A * | 8/1977 | Perrault et al. | 248/73 |
| 4,065,883 | A | 1/1978 | Thibodeau | |
| 4,446,805 | A | 5/1984 | Sugahara et al. | |
| 4,663,894 | A | 5/1987 | LaRoche et al. | |
| 4,697,399 | A | 10/1987 | Ryan | |
| 4,860,502 | A | 8/1989 | Mickelson | |
| 5,511,351 | A | 4/1996 | Moore | |
| 5,598,785 | A * | 2/1997 | Zaguroli, Jr. | 104/111 |
| 5,605,022 | A | 2/1997 | Fulton | |
| 5,765,328 | A | 6/1998 | Moore | |
| 5,765,329 | A | 6/1998 | Huang | |
| 5,867,943 | A | 2/1999 | Thomas | |
| 5,941,483 | A * | 8/1999 | Baginski | 248/68.1 |
| 6,079,673 | A * | 6/2000 | Cox | 248/63 |
| 6,164,019 | A | 12/2000 | Salley | |
| 6,171,540 | B1 * | 1/2001 | Ibaragi | 264/328.1 |
| 6,226,941 | B1 | 5/2001 | Stevens | |
| 6,226,956 | B1 | 5/2001 | Davis et al. | |
| 6,240,690 | B1 | 6/2001 | James et al. | |
| 6,244,006 | B1 | 6/2001 | Shue et al. | |
| 6,260,316 | B1 | 7/2001 | Davis et al. | |
| 6,279,271 | B1 | 8/2001 | Burkart, Jr. | |
| 6,308,479 | B1 | 10/2001 | Prohofsky | |
| 6,343,450 | B1 | 2/2002 | Vance, Jr. | |
| 6,385,931 | B1 | 5/2002 | Risser | |
| 6,393,785 | B1 | 5/2002 | Burt | |
| 6,415,571 | B2 | 7/2002 | Risser | |
| 6,421,967 | B1 | 7/2002 | Wlaker | |
| 6,447,390 | B1 | 9/2002 | O'Hagin | |
| 6,688,059 | B1 | 2/2004 | Walker | |
| 6,694,686 | B2 | 2/2004 | Ready et al. | |
| 6,796,092 | B1 | 9/2004 | Goebel | |
| 6,886,302 | B2 | 5/2005 | Jackson | |
| 7,028,437 | B2 | 4/2006 | Hauck | |
| 7,234,281 | B2 | 6/2007 | Hauck | |
| 7,424,790 | B2 | 9/2008 | Austin et al. | |
| 8,082,712 | B1 | 12/2011 | Butler et al. | |
| 2001/0029706 | A1 | 10/2001 | Risser | |

(Continued)

*Primary Examiner* — Jonathan Liu
*Assistant Examiner* — Taylor Morris
(74) *Attorney, Agent, or Firm* — Hartman & Citrin LLC

(57) ABSTRACT

A deck drainage system bracket is disclosed. According to embodiments, the deck drainage system bracket can include a main hanger portion and a hanger swing portion. The main hanger portion and the hanger swing portion can be assembled together to form the deck drainage system bracket. The main hanger portion can have one or more mounting surfaces having a number of mounting holes for mounting the main hanger portion to a deck joist or other support structure. The main hanger portion and the hanger swing portion can cooperate to form an opening for grasping a standing seam or other portion of one or more deck drainage panels.

16 Claims, 13 Drawing Sheets

FIG. 2

(56) References Cited

U.S. PATENT DOCUMENTS

| | | | | |
|---|---|---|---|---|
| 2002/0032990 | A1 | 3/2002 | Burkart, Jr. | |
| 2002/0035811 | A1 * | 3/2002 | Heuel | 52/506.05 |
| 2003/0029096 | A1 | 2/2003 | Burkart, Jr. | |
| 2003/0074850 | A1 | 4/2003 | Ready et al. | |
| 2004/0020136 | A1 | 2/2004 | Hauck | |
| 2005/0217203 | A1 | 10/2005 | Haddock | |
| 2005/0252151 | A1 | 11/2005 | Kindred | |
| 2006/0162262 | A1 | 7/2006 | Smith | |
| 2007/0175106 | A1 | 8/2007 | Rotter | |

* cited by examiner

DECK DRAINAGE SYSTEM BRACKETS

TECHNICAL FIELD

The present disclosure relates generally to deck drainage systems. More particularly, the present disclosure relates to deck drainage system brackets for supporting deck drainage systems.

BACKGROUND

Some homes include decks that can be used for outdoor activities such as hosting parties, outdoor cooking, and the like. Decks may be built from wood or synthetic lumber. If lumber is used, the lumber may be spaced apart to allow liquids and debris to pass through to exposed ground under the deck. As such, space under the deck may be unusable due to falling liquid and/or debris and/or because sunlight may be blocked by the deck. Thus, some people use space under a deck for storage or do not use the space at all.

One solution to this problem is to equip decks with a deck drainage system. A deck drainage system may capture liquids and/or debris falling through the deck and may route the liquids and/or debris to a gutter or other outlet. One type of drainage system may include drainage panels that can be joined together to provide a substantially solid ceiling for space under the deck. One downside to some of these drainage systems is that these systems rely on heavy self-supporting interconnected panels and/or alternatively may require use of brackets to support the drainage panels.

Some decks are made with pressure treated lumber. Until recently, pressure treated lumber typically used for outdoor decks was treated with chromated copper arsenate ("CCA"). CCA is an arsenic-containing additive now regulated by the U.S. Federal Government as a toxic pesticide. One fairly recent replacement for CCA is alkaline copper quaternary ("ACQ"), which has become a popular substitute for CCA that is used in many outdoor decks.

Some brackets used for deck drainage systems, however, can be formed from various metals such as steel, aluminum, or other materials. Steel is heavy and may tend to rust and/or otherwise corrode over time. Aluminum can be more resistant to liquid and other elements relative to steel and can be lighter than steel when used in similar volumetric proportions. Aluminum, however, may corrode when exposed to liquid and ACQ-treated lumber.

Because of these and other challenges, retrofitting decks with drainage systems can pose various challenges. These challenges may be compounded if the deck is formed from ACQ-treated lumber. Furthermore, drainage system components can be expensive and adding a drainage system therefore may be cost-prohibitive for some homeowners. As such, some homeowners may forego adding a drainage system to a deck, thereby sacrificing space under a deck for safety and/or cost concerns.

It is with respect to these and other considerations that the disclosure made herein is presented.

SUMMARY

The present disclosure is directed to a deck drainage system bracket. According to the concepts and technologies disclosed herein, a deck drainage system bracket includes a main hanger portion and hanger swing portion that can be assembled together to form the deck drainage system bracket. The main hanger portion can have one or more mounting surfaces having a number of mounting holes for mounting the main hanger portion to a deck joist or other support structure. The main hanger portion and the hanger swing portion can cooperate to form an opening for grasping a standing seam or other portion of one or more deck drainage panels.

In some embodiments, the deck drainage system bracket includes two mounting surfaces offset by about ninety degrees for allowing installation of the deck drainage brackets with joists that run lengthwise parallel to, or perpendicular to, a desired flow path of the deck drainage system. As such, a standing seam engaged by the deck drainage system bracket can extend in a first direction that is perpendicular to or parallel to a joist to which the deck drainage system bracket is attached. The main hanger portion and/or the hanger swing portion can be formed from plastics or other polymers, epoxies, resins, or other chemicals. In one embodiment, the main hanger portion and/or the hanger swing portion are formed from glass-filled NYLON. Glass-filled NYLON can be resistant to corrosion including ACQ-induced corrosion, and can be easy to manufacture and transfer due to the ability to form the deck drainage system brackets using injection molding and the light weight of NYLON and/or other polymers relative to metals and alloys. Furthermore, plastics and polymers can be cheaper than metals and alloys, thus reducing the price of the deck drainage system brackets while providing a tensile strength that can exceed that provided by metals and alloys. Thus, embodiments of the deck drainage system brackets can provide enhanced strength, cheaper manufacturing and transfer costs, and resistance to corrosion and/or other breakdown, relative to other designs and/or materials.

The deck drainage system bracket also can include ribs, supports, and notches and notch recesses that can be provided to increase the strength of the deck drainage system bracket relative to other designs. Furthermore, the main hanger portion and the hanger swing portion can include tabs configured to engage deck drainage panels contacted and/or supported by the deck drainage system brackets. The main hanger portion and the hanger swing portion also can include, respectively, hanger guides and hangers that can be used to allow pre-assembly and/or assembly of the deck drainage system bracket, as well as reducing rotation of the hanger swing portion relative to the main hanger portion.

According to an aspect, a deck drainage system bracket includes a hanger swing portion including a hanger, a first tab, and a first assembly hole, and main hanger portion having a mounting surface including at least one mounting hole formed therethrough, a second assembly hole, a second tab, and a hanger guide for engaging the hanger of the hanger swing portion. In some embodiments, a fastening mechanism can be passed through the first assembly hole and the second assembly hole, and an insert can be disposed in at least one of a first insert recess formed in the main hanger portion or a second insert recess formed in the hanger swing portion for engaging the fastener.

In some embodiments, at least a portion of the main hanger portion can be formed from glass-filled NYLON. The hanger can include one or more hangers, and the hanger guide can include one or more hanger guides. In some embodiments, a notch can be formed in the hanger swing portion and a notch recess can be formed in the main hanger portion for engaging the notch. In some embodiments, the hanger includes one or more hangers, the hanger guide includes one or more hanger guides, the notch includes one or more notches, and the notch recess includes one or more notch recesses. The mounting surface can include two mounting surfaces, each of the mounting surfaces including one or more mounting holes. In some embodiments, the first tab is located proximate to a first side of the hanger swing portion and the hanger swing portion includes a first aperture configured to allow visual access to the first tab from a second side of the hanger swing portion. In some embodiments, the second tab is located proximate to a first side of the main hanger portion, and the main hanger portion includes a second aperture configured to allow visual access to the second tab from a second side of the main hanger portion. In some embodiments, the deck drainage system bracket further includes one or more supports extending from at least a portion of a first of the two mounting surfaces to at least a portion of a second of the two mounting surfaces.

According to another aspect, a deck drainage system bracket includes a hanger swing portion including one or more hangers, a first tab, a first pair of assembly holes, a fastener recess, and an insert recess for housing an insert. The deck drainage system also includes a main hanger portion including a first mounting surface and a second mounting surface. Each of the first mounting surface and the second mounting surface can include one or more mounting holes for mounting the deck drainage system bracket to a support surface. The main hanger portion of the deck drainage system bracket also can include a second pair of assembly holes configured to cooperate with the first pair of assembly holes to provide a pair of assembly passageways, a second tab, and one or more hanger guides for engaging the one or more hangers of the hanger swing portion.

In some embodiments, the deck drainage system bracket further includes a fastening mechanism passed through at least one of the pair of assembly passageways and into the insert. At least a portion of the main hanger portion can be formed from glass-filled NYLON, and at least a portion of the hanger swing portion also can be formed from glass-filled NYLON. In some embodiments, the deck drainage system further includes one or more notches formed in the hanger swing portion and one or more notch recesses formed in the main hanger portion for engaging the one or more notches. In some embodiments, the first tab is located proximate to a first side of the hanger swing portion and the hanger swing portion includes a first aperture configured to allow visual access to the first tab from a second side of the hanger swing portion. In some embodiments, the second tab is located proximate to a first side of the main hanger portion, and the main hanger portion includes a second aperture configured to allow visual access to the second tab from a second side of the main hanger portion. In some embodiments, one or more supports extends from at least a portion of the first mounting surface to at least a portion of the second mounting surface, and the deck drainage system bracket further includes at least one rib for supporting at least a portion of the main hanger portion.

According to yet another aspect, a deck drainage system bracket includes a hanger swing portion including one or more hangers, a first tab for engaging at least a portion of a deck drainage panel, one or more notches, a first pair of assembly holes, a fastener recess, and an insert recess for housing an insert. The deck drainage system bracket also can include a main hanger portion including a first mounting surface and a second mounting surface, a second pair of assembly holes configured to cooperate with the first pair of assembly holes to provide a pair of assembly passageways, one or more notch recesses, a second tab for engaging at least a portion of a further deck drainage panel, and one or more hanger guides for engaging the one or more hangers of the hanger swing portion. Each of the first mounting surface and the second mounting surface can include one or more mounting holes for mounting the deck drainage system bracket to a support surface of a deck. The deck drainage system bracket further can include a fastening mechanism passed through at least one of the pair of assembly passageways and into the insert.

According to some embodiments, at least a portion of the main hanger portion can be formed from glass-filled NYLON, and at least a portion of the hanger swing portion can be formed from glass-filled NYLON. In some embodiments, the first tab can be located proximate to a first side of the hanger swing portion and the hanger swing portion includes a first aperture configured to allow visual access to the first tab from a second side of the hanger swing portion. According to some embodiments, the second tab can be located proximate to a first side of the main hanger portion and the main hanger portion can include a second aperture configured to allow visual access to the second tab from a second side of the main hanger portion. According to some embodiments, the deck drainage system bracket can include one or more supports extending from at least a portion of the first mounting surface to at least a portion of the second mounting surface and one or more ribs on the main hanger portion and the hanger swing portion for supporting at least a portion of the main hanger portion or the hanger swing portion.

This Summary is provided to introduce a selection of concepts in a simplified form that are further described below in the Detailed Description. This Summary is not intended to identify key features or essential features of the claimed subject matter, nor is it intended that this Summary be used to limit the scope of the claimed subject matter. Furthermore, the claimed subject matter is not limited to implementations that solve any or all disadvantages noted in any part of this disclosure.

DETAILED DESCRIPTION

Figure 1:
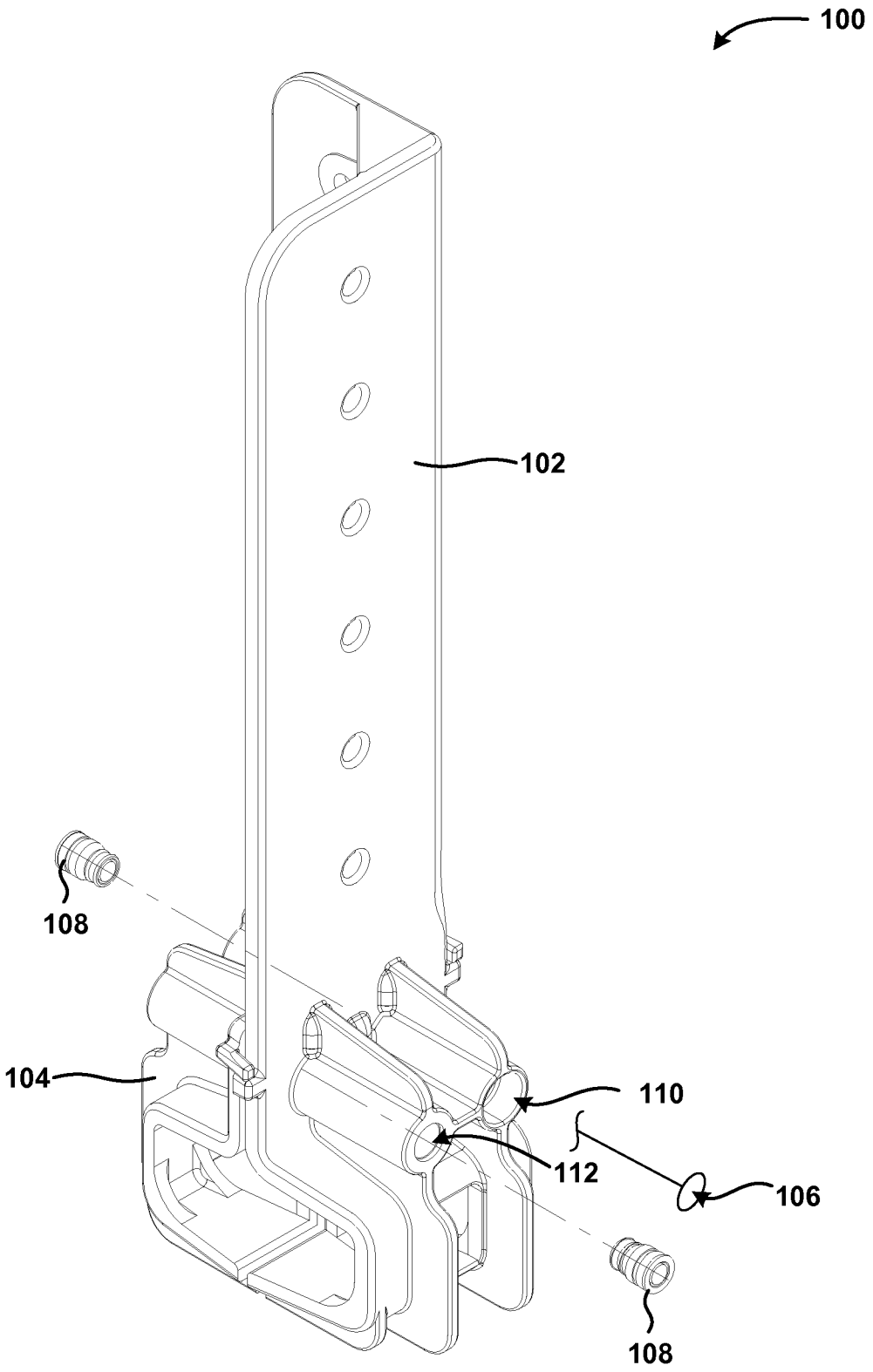
FIG. 1 is a perspective view illustrating a deck drainage system bracket, according to an illustrative embodiment.

The following detailed description is directed to a deck drainage system bracket. According to various embodiments, the deck drainage system bracket can include a main hanger portion and a hanger swing portion. The main hanger portion and the hanger swing portion can be assembled together to form the deck drainage system bracket. The main hanger portion can have one or more mounting surfaces with a number of mounting holes. The mounting holes can be used to mount the main hanger portion to a deck joist or other support structure. In some embodiments, the deck drainage system bracket includes two mounting surfaces offset by about ninety degrees for allowing installation of the deck drainage brackets with joists that run lengthwise parallel to, or perpendicular to, a desired flow path of the deck drainage system.

The main hanger portion and the hanger swing portion can cooperate to form an opening for grasping a standing seam or other portion of one or more deck drainage panels. The main hanger portion and/or the hanger swing portion can be formed from plastics or other polymers, epoxies, resins, or other chemicals. In one embodiment, the main hanger portion and/or the hanger swing portion are formed from glass-filled NYLON or other polymers. Thus, embodiments of the deck drainage system brackets can provide enhanced strength, cheaper manufacturing and transfer costs, and resistance to corrosion and/or other breakdown, relative to metals, alloys, or other materials that could be used to form the deck drainage system brackets.

The deck drainage system bracket also can include ribs, supports, and notches and notch recesses that can be provided to add strength to the deck drainage system bracket. The main hanger portion and the hanger swing portion also can include tabs configured to engage deck drainage panels contacted and/or supported by the deck drainage system brackets. The main hanger portion and the hanger swing portion also can include, respectively, hanger guides and hangers that can be used to allow pre-assembly and/or assembly of the deck drainage system bracket, as well as reduce rotation of the hanger swing portion relative to the main hanger portion when assembled. These and other aspects of the deck drainage system bracket disclosed herein will be discussed in more detail below with reference to the FIGURES.

In the following detailed description, references are made to the accompanying drawings that form a part hereof, and in which are shown by way of illustration specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of a deck drainage system bracket will be presented.

FIG. 1 is a perspective view illustrating a deck drainage system bracket 100, according to an illustrative embodiment. According to various embodiments, including the embodiment illustrated in the various FIGURES, the deck drainage system bracket 100 is an assembly of a main hanger portion 102 and a hanger swing portion 104. The deck drainage system bracket 100 can be used to support various components of a deck drainage system including, but not limited to, deck drainage panels and other structures. The main hanger portion 102 and the hanger swing portion 104 can be assembled together with various fasteners 106. According to various embodiments, the fasteners 106 can include, but are not limited to, bolts, rivets, screws, pins, or other fasteners.

The fastener 106 can mate or otherwise couple with an insert 108 or other reciprocal fastening mechanism. In the illustrated embodiment, the fastener 106 passes through a fastener recess 110 formed in the main hanger portion 102 and mates with an insert 108 disposed in an insert recess 112 formed in the hanger swing portion 104. As shown in FIG. 1, the main hanger portion 102 also can include an insert recess 112 and an insert 108 disposed in the insert recess 112. In FIG. 1, the fastener 106 is illustrated as being inserted through the fastener recess 110 formed in the main hanger portion 102 and into the insert 108 disposed in the insert recess 112 formed in the hanger swing portion 104. In light of the description above, it can be appreciated that the fastener 106 can additionally or alternatively be inserted through a fastener recess 110 formed in the hanger swing portion 104 and into the insert 108 located in the insert recess 112 of the main hanger portion 102. As such, the illustrated embodiment should be understood as being illustrative and should not be construed as being limiting in any way.

As shown in FIG. 1, the deck drainage system bracket 100 can be formed by assembling the main hanger portion 102 with the hanger swing portion 104 using the fastener 106 or a number of the fasteners 106. Although not shown in FIG. 1, the main hanger portion 102 can be fastened or connected to a joist or other support structure. Because the main hanger portion 102 and the hanger swing portion 104 can be assembled by inserting the fastener 106 from either side of the deck drainage system bracket 100, the deck drainage system bracket 100 can be added to a deck drainage system and attached to joists or other support structures in various directions, relative to the deck drainage system bracket 100. The various structures of the main hanger portion 102 and the hanger swing portion 104, as well as some example implementations of the deck drainage system brackets 100 are illustrated and described in more detail below.

According to some embodiments, the main hanger portion 102 and/or the hanger swing portion 104 of the deck drainage system bracket 100 can be formed from a same material. In other embodiments, the main hanger portion 102 and the hanger swing portion 104 of the deck drainage system bracket 100 are formed from different materials. According to various embodiments, one or more of the main hanger portion 102 and/or the hanger swing portion 104 are formed from glass-filled NYLON. For example, in one embodiment the main hanger portion 102 and the hanger swing portion 104 are formed from NYLON 66 33% GF. In another embodiment, the main hanger portion 102 and/or the hanger swing portion 104 are formed from PC 141 Black. According to various embodiments, the materials used to form the deck drainage system bracket 100 are safe to use with ACQ-treated lumber.

Furthermore, some embodiments of the deck drainage system bracket 100, including some embodiments of the deck drainage system brackets 100 formed from glass-filled NYLON, can be cheap to manufacture, light and therefore cheap to ship, and can have smooth edges that can avoid or eliminate injuries to installers caused by sharp edges of some metal brackets. Other materials are contemplated and are possible. As such, it should be understood that these embodiments are illustrative, and should not be construed as being limiting in any way.

According to some embodiments, the functionality of the fasteners 106 is provided by a screw or bolt. In one embodiment, the functionality of the fasteners 106 is provided by 10-32×3-inch machine screws with a Phillips pan head formed from 18-8 stainless steel. In this embodiment, the functionality of the insert is provided by a DODGE insert sold under the model number 6041-3BR 375, which can be installed in the insert recesses 112 using ultrasonic equipment or thermal installation equipment, among other contemplated insertion processes. Because other fasteners 106 and inserts 108 are possible and are contemplated, it should be understood that these embodiments are illustrative, and should not be construed as being limiting in any way.

Figure 2:
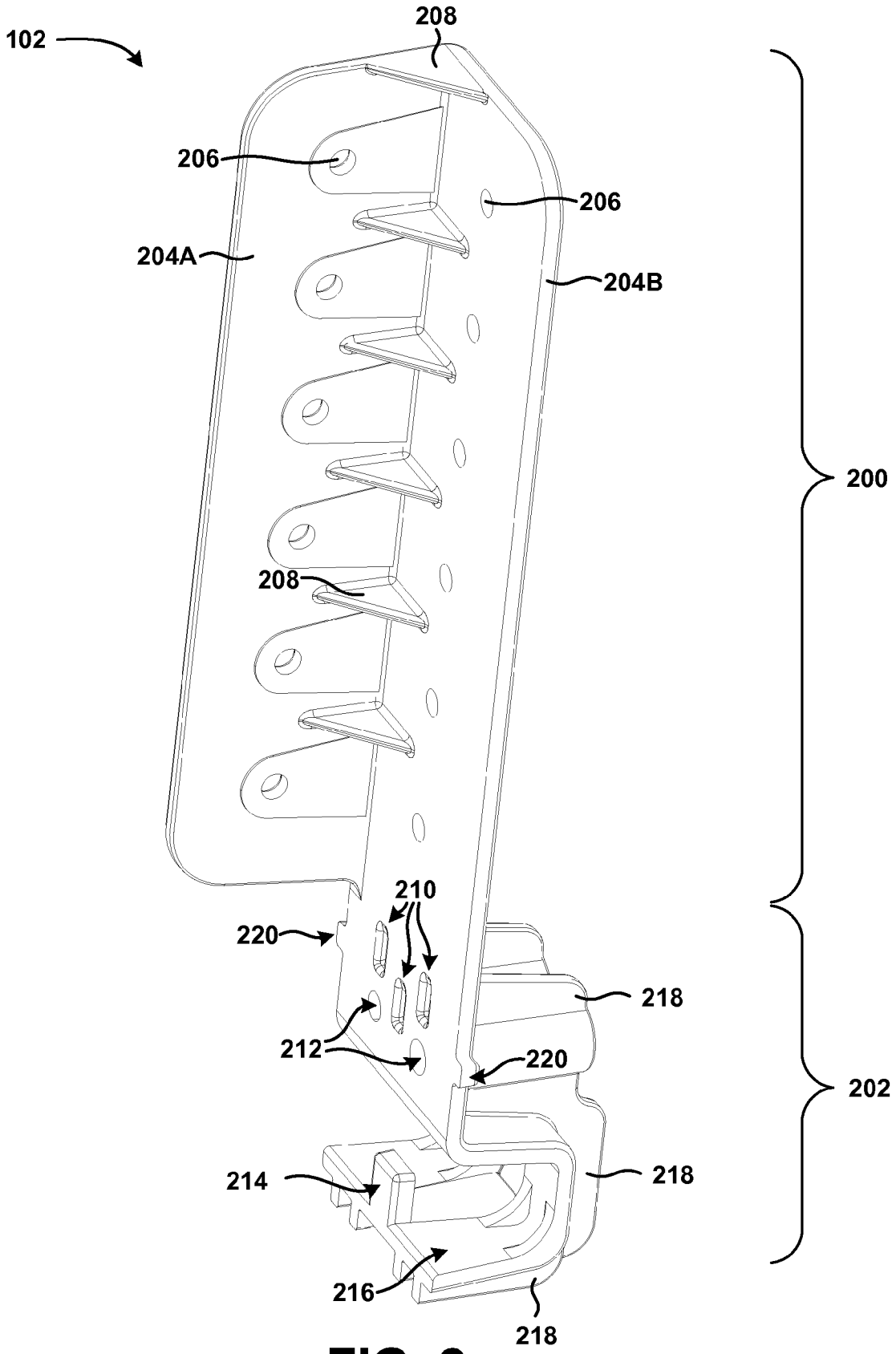
FIG. 2 is a perspective view illustrating a main hanger portion of the deck drainage system bracket, according to an illustrative embodiment.

Turning now to FIG. 2, additional aspects of the main hanger portion 102 are described in more detail. As shown in FIG. 2, the main hanger portion 102 includes an upper portion 200 and a lower portion 202. The upper portion 200 includes mounting surfaces 204A-B (hereinafter collectively and/or generically referred to as "mounting surfaces 204"). The mounting surfaces 204 can include a number of mounting holes 206 via which the deck drainage system bracket 100 can be connected or attached to various support surfaces such as deck joists, or the like. Multiple mounting holes 206 can be included for configurability and/or to accommodate various support structure heights or configurations.

It should be understood that a portion of the deck drainage system bracket 100 can be cut from the upper portion 200 to shorten the length of the deck drainage system bracket 100. Similarly, additional mounting holes 206 can be formed above, between, or below the illustrated mounting holes 206 using a drill or other tool, if desired. Although not shown in FIG. 2, it can be appreciated that in various embodiments the deck drainage system bracket 100 is attached, via attachment mechanisms such as screws, nails, or the like that can be passed through the mounting holes 206, to a joist or other support surface of a deck or other structure. Thus, the two or more mounting surfaces 204 can be included to allow installers to mount the deck drainage system bracket 100 to various support surfaces in various configurations while maintaining the deck drainage panels, which can be grasped by the lower portion 202 of the deck drainage system bracket 100, in a single direction that is substantially parallel to either of the mounting surfaces 204. Examples of deck drainage panels held by the deck drainage system bracket 100 are illustrated in FIGS. 12-13.

Figure 12:
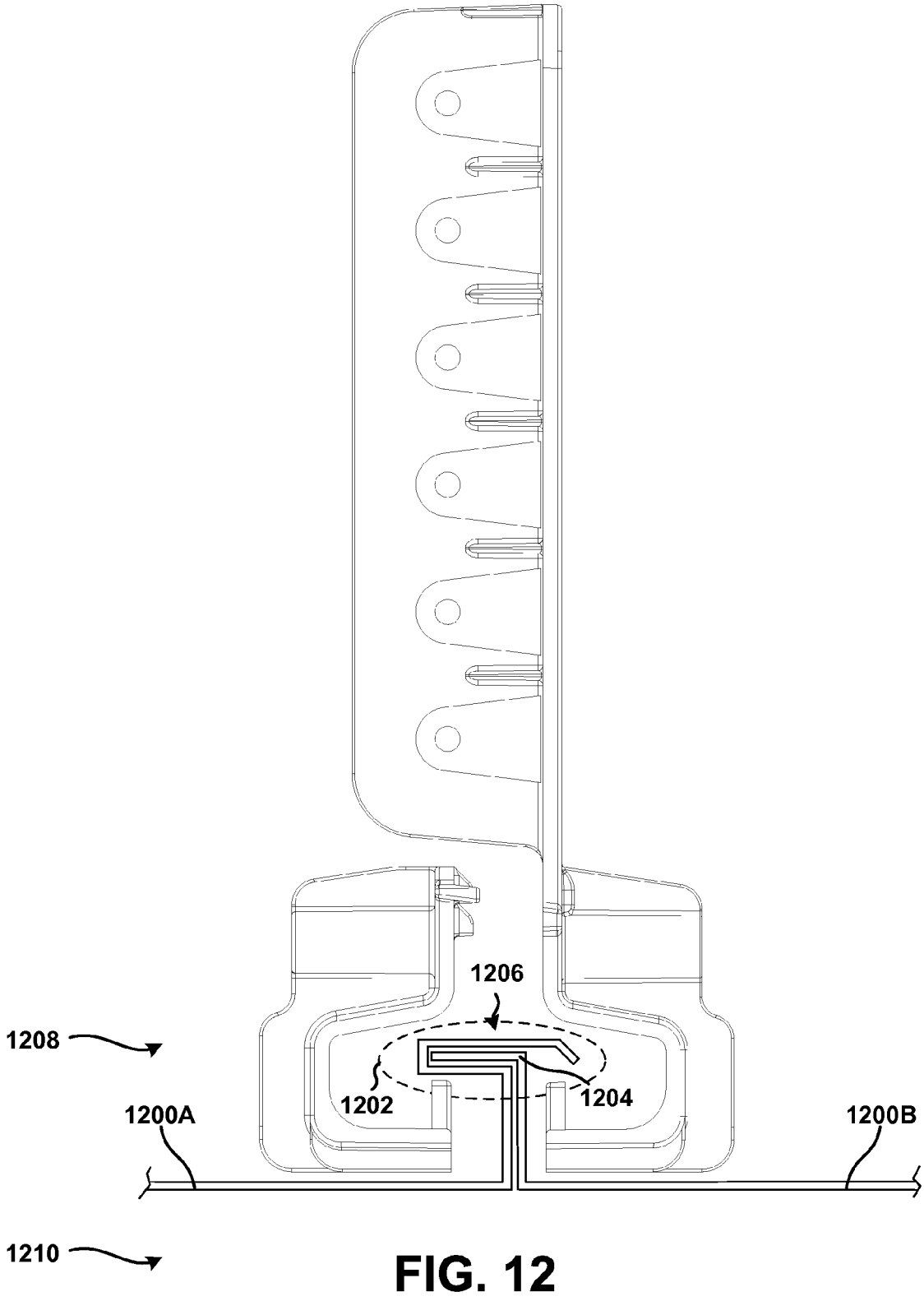
FIGS. 12-13 illustrate example implementations of the deck drainage system bracket in a deck drainage system, according to some illustrative embodiments.
Figure 13:
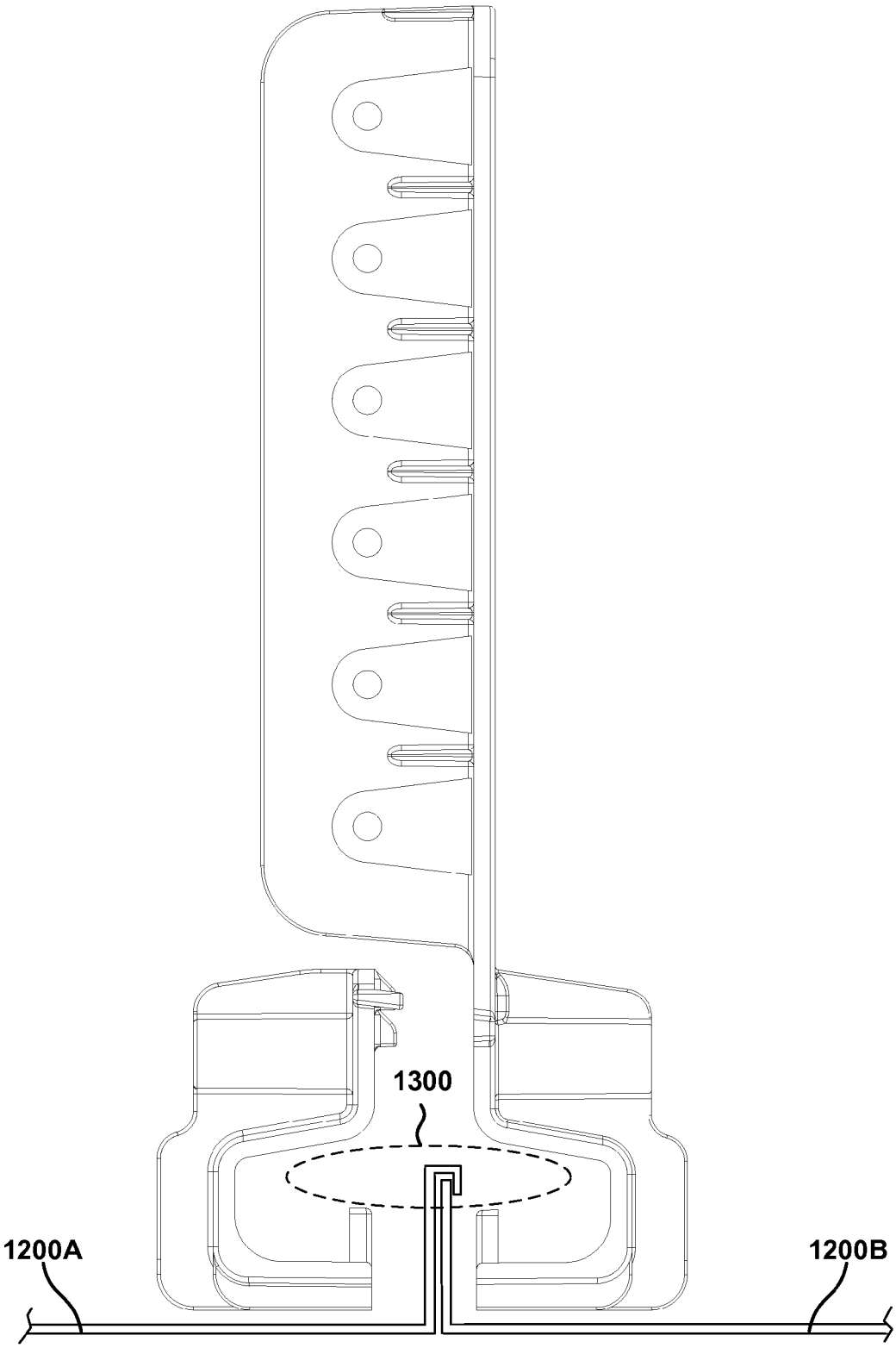

In particular, as will be more easily understood with reference to FIGS. 12-13, one or more drainage panels can be supported by the deck drainage system bracket 100. A length of drainage panels can extend in a direction that is parallel to either of the mounting surfaces 204. As such, the deck drainage system bracket 100 can include two mounting surfaces 204 arranged perpendicular to one another to allow use of the deck drainage system bracket 100 in various deck drainage system configurations wherein deck joists may run parallel or perpendicular to a desired flow path for liquid or debris collected by the deck drainage system.

It should be appreciated that the deck drainage system bracket 100 can include additional mounting surfaces 204 and/or that the mounting surfaces 204 can be alternatively arranged, if desired, to accommodate additional or alternative deck drainage system panel arrangements. For example, in one contemplated embodiment, the deck drainage system bracket 100 includes a third mounting surface 204 arranged with approximately a forty-five degree offset from the orientation either or both of the mounting surfaces 204 shown in FIG. 2. It should be understood that this embodiment is illustrative, and should not be construed as being limiting in any way.

In various embodiments, the deck drainage system bracket 100 also can include supports 208. The supports 208 can be formed between the mounting surfaces 204 and can be included to provide the deck drainage system bracket 100 with support and/or rigidity. The supports 208 can be solid structures (as shown) and/or can be formed as ribs or hollowed support surfaces. The configuration of the supports 208 can be varied depending upon various considerations such as, for example, material costs, anticipated support strength requirements, weight requirements, shipping costs, and the like. As such, the illustrated embodiment should be understood as being illustrative and should not be construed as being limiting in any way.

The deck drainage system bracket 100 also can include a number of notch recesses 210 formed in the lower portion 202 or elsewhere in the deck drainage system bracket 100. The notch recesses 210 can accommodate notches or other structures formed in the hanger swing portion 104, which is illustrated and described in more detail below, particularly with reference to FIGS. 7-10. Thus, the configuration, size, location, and number of notch recesses 210 can be varied based, at least partially, upon the configuration, size, location, and/or number of notches included on the hanger swing portion 104. Thus, the illustrated embodiment of the notch recesses 210 should be understood as being illustrative and should not be construed as being limiting in any way.

The lower portion 202 is illustrated as including two assembly through holes ("assembly holes") 212. As shown in FIG. 1, a fastener 106 such as a bolt, screw, or the like, can be passed through the main hanger portion 102 and the hanger swing portion 104 to assemble the deck drainage system bracket 100. The assembly holes 212 can be part of the assembly passageways used to accommodate the fasteners 106 as described herein. As such, the orientation, number, size, configuration, and/or other aspects of the assembly holes 212 can be varied based upon design, strength, durability, and/or other manufacturing and/or use considerations. The illustrated embodiment should therefore be understood as being illustrative and should not be construed as being limiting in any way.

According to various embodiments, the main hanger portion 102 can include a tab 214. As shown in FIG. 1, the hanger swing portion 104 also can include a tab, which will be illustrated and described in more detail below. Briefly, the tab 214 of the main hanger portion 102 can interface with a supported deck drainage panel to increase support of the deck drainage system bracket 100, to reduce slippage and/or other movement of the drainage panels relative to the deck drainage system bracket 100, and/or to shift weight from a lower support surface 216 of main hanger portion 102 to other areas or support structures of the main hanger portion 102. It should be understood that the illustrated configuration, orientation, and size of the tab 214 are illustrative and should not be construed as being limiting in any way.

The main hanger portion 102 also can include a number of support and/or manufacturing ribs ("ribs") 218. The ribs 218 can be included to add support and/or rigidity to various structures of the main hanger portion 102 and/or to aid in manufacturing. With respect to supporting the various structures of the deck drainage system bracket 100, it can be appreciated with reference to the various FIGURES that the ribs 218 can be arranged to support the various structures of the deck drainage system bracket 100 to help avoid or even eliminate breakage or other failures of the deck drainage system bracket 100. Because support structures are generally understood, the support functions of the ribs 218 are not described further herein but can be appreciated with reference to the FIGURES.

With respect to manufacturing, the ribs 218 also can be included to aid in forming the deck drainage system brackets 100. In particular, the main hanger portion 102 and/or the hanger swing portion 104 can be formed using a molding process such as an injection molding process. As such, the ribs 218 can be included to simplify and/or otherwise facilitate removal of the main hanger portion 102 and/or the hanger swing portion 104 from molds used to form the main hanger portion 102 and/or the hanger swing portion 104. Because injection molding and other similar processes are generally understood, the manufacturing uses of the ribs 218 are not described herein in additional detail. It should be understood that the relative location, orientation, size, and/or number of ribs 218 are merely illustrative of one contemplated embodiment and should not be construed as being limiting in any way.

The main hanger portion 102 also can include hanger guides 220. The hanger guides 220 can be included for aligning and/or supporting hangers formed on the hanger swing portion 104. The hangers of the hanger swing portion 104 are illustrated and described in more detail below, particularly with reference to FIGS. 7-10. Briefly, the hangers and hanger guides 220 can be included to allow pre-assembly of the deck drainage system bracket 100 and support of the various components thereof during mounting of a deck drainage system. The hangers and hanger guides 220 also can provide additional support for the deck drainage system bracket 100 by restricting rotation of the hanger swing portion 104 relative to the main hanger portion 102 about a fastener inserted through the assembly holes 212. These and other purposes and uses of the hangers and hanger guides 220 will be more clearly understood with reference to FIGS. 3-13.

Figure 3:
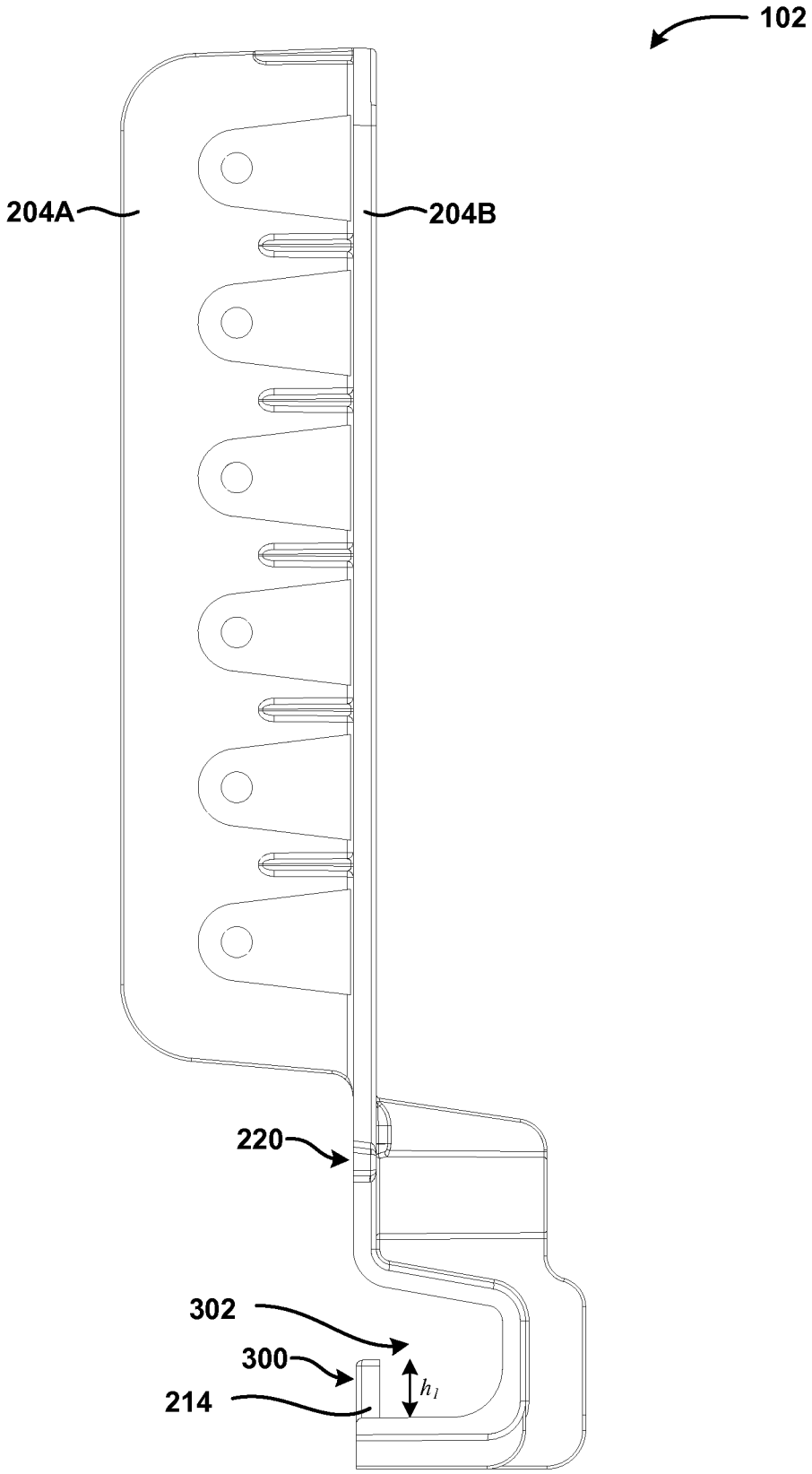
FIG. 3 is a side elevation view of the main hanger portion of the deck drainage system bracket, according to an illustrative embodiment.

With additional reference to FIGS. 3-6, the arrangement of various structures of the deck drainage system bracket 100, including some components discussed above with reference to FIGS. 1-2, can be more clearly understood. With reference to FIG. 3, it can be appreciated that a contact surface 300 of the tab 214 can be, but is not necessarily, substantially parallel to the mounting surface 204B. In some embodiments, the body or main portion of the tab 214 is tilted away or toward the illustrated location of the support surface 300 as a result of a thermal manufacturing process used to form the main hanger portion 102. As such, it should be understood that the profile, orientation, and relative size of the tab 214 can vary, depending upon various considerations.

Furthermore, some aspects of the tab 214 are varied or modified by manufacturers or installers for known use requirements. For example, the height $h_1$ of the tab 214 can be varied to accommodate various sizes and configurations of drainage panels. The height $h_1$ can be varied during manufacturing or post-manufacturing using a file or other tool, if desired. Similarly, a relative size and configuration of the opening 302 for accommodating the drainage panels can be varied by varying various orientations, sizes, configurations, and/or other aspects of the lower portion 202 of the main hanger portion 102. As such, the illustrated embodiment of the main hanger portion 102 shown in FIG. 3 should be understood as being illustrative and should not be construed as being limiting in any way.

Figure 4:
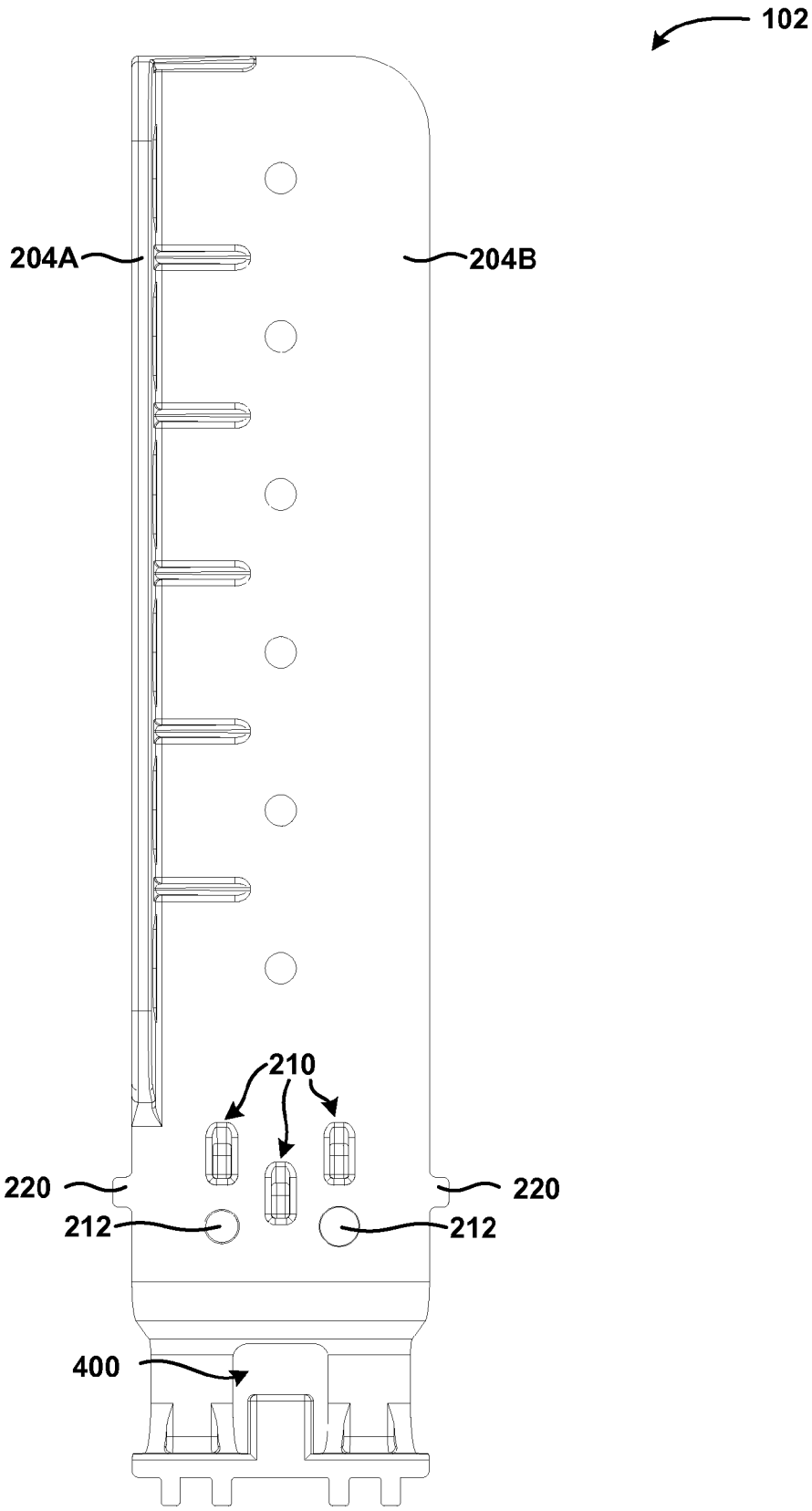
FIG. 4 is a front elevation view of the main hanger portion of the deck drainage system bracket, according to an illustrative embodiment.
Figure 5:
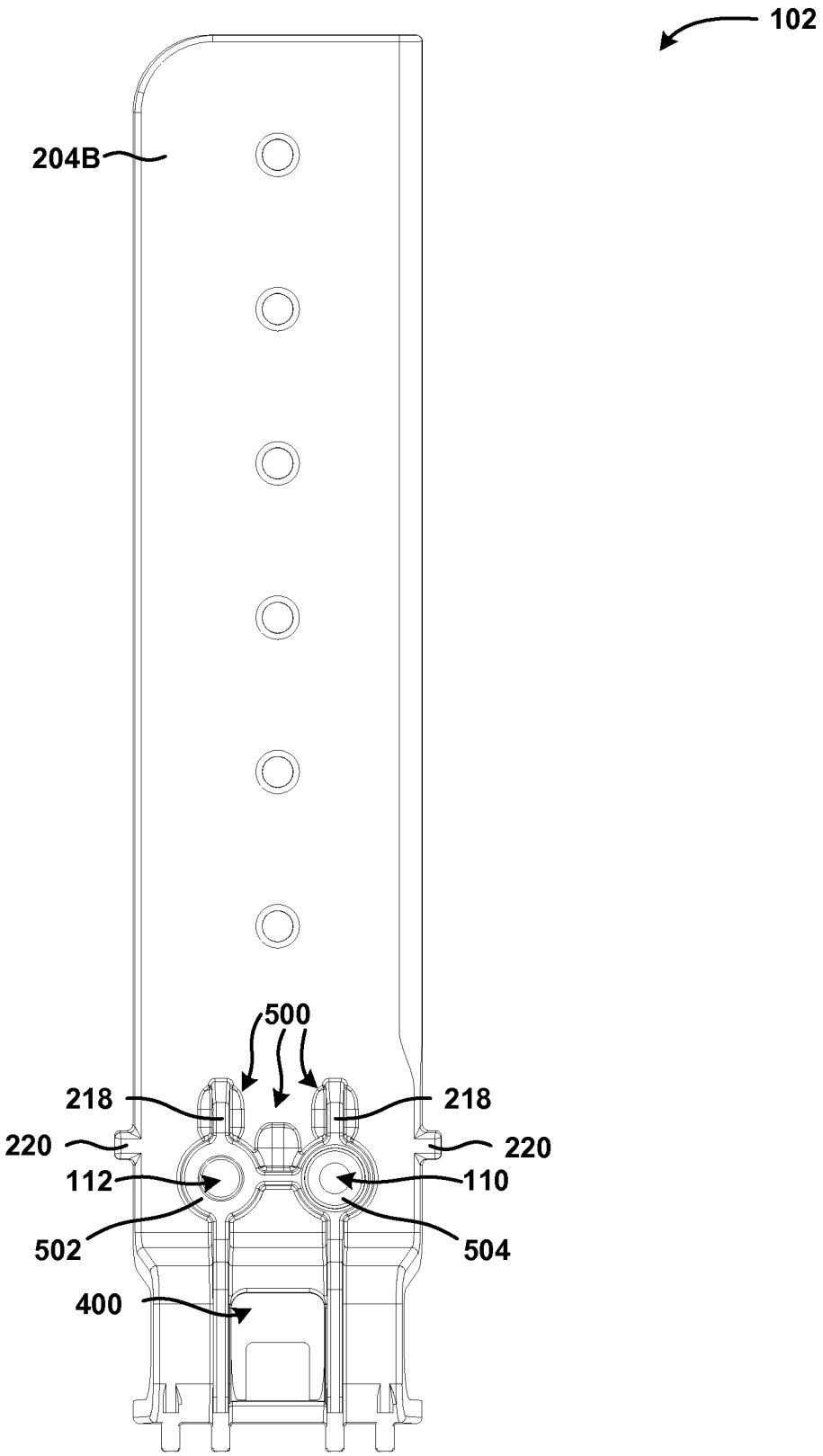
FIG. 5 is a rear elevation view of the main hanger portion of the deck drainage system bracket, according to an illustrative embodiment.

As can be seen in FIG. 4, the main hanger portion 102 also can include an aperture 400 formed in the lower portion 202. The aperture 400 can be included for various purposes including, but not limited to, reducing the amount of material used to form the main hanger portion 102, to reduce stresses on angles and/or bends of the main hanger portion 102, to reduce a weight of the main hanger portion 102, or the like. The aperture 400 also can be included to examine the tab 214 post-installation from above the drainage panels, if desired. As such, installers can verify placement of the deck drainage system brackets 100 and/or drainage panels via the aperture 400, if desired. In FIG. 5, rear notch recess support areas 500 are visible as bulges of material disposed behind the notch recesses 210.

In some embodiments, including the embodiment illustrated in the FIGURES, the rear notch recess support areas 500 are disposed in-line with the ribs 218 to further strengthen the various structures of the deck drainage system bracket 100 and/or to transfer forces from the notch recesses 210 to other structures of the deck drainage system bracket 100. It should be understood that the size, location, orientation, and number of rear notch recess support areas 500 can be varied in accordance with variation of the notch recesses 210 and/or the notches described below with reference to FIGS. 7-10. As such, the illustrated embodiment should be understood as being illustrative and should not be construed as being limiting in any way.

In some embodiments, as shown in FIG. 5, a lip 502 can be provided in the insert recess 112. The lip 502 can be provided to stop insertion of the insert 108 or other fastening mechanism into the insert recess 112. As such, the lip 502 can support an insert 108 inserted into the insert recess 112, if desired. Similarly, the fastener recess 110 can include a fastener support structure 504 such as a lip, or the like. The fastener support structure 504 is included, in some embodiments, to support a screw or bolt head of the fastener 106 used to assemble the deck drainage system bracket 100. It should be understood that this embodiment is illustrative, and should not be construed as being limiting in any way.

Figure 6:
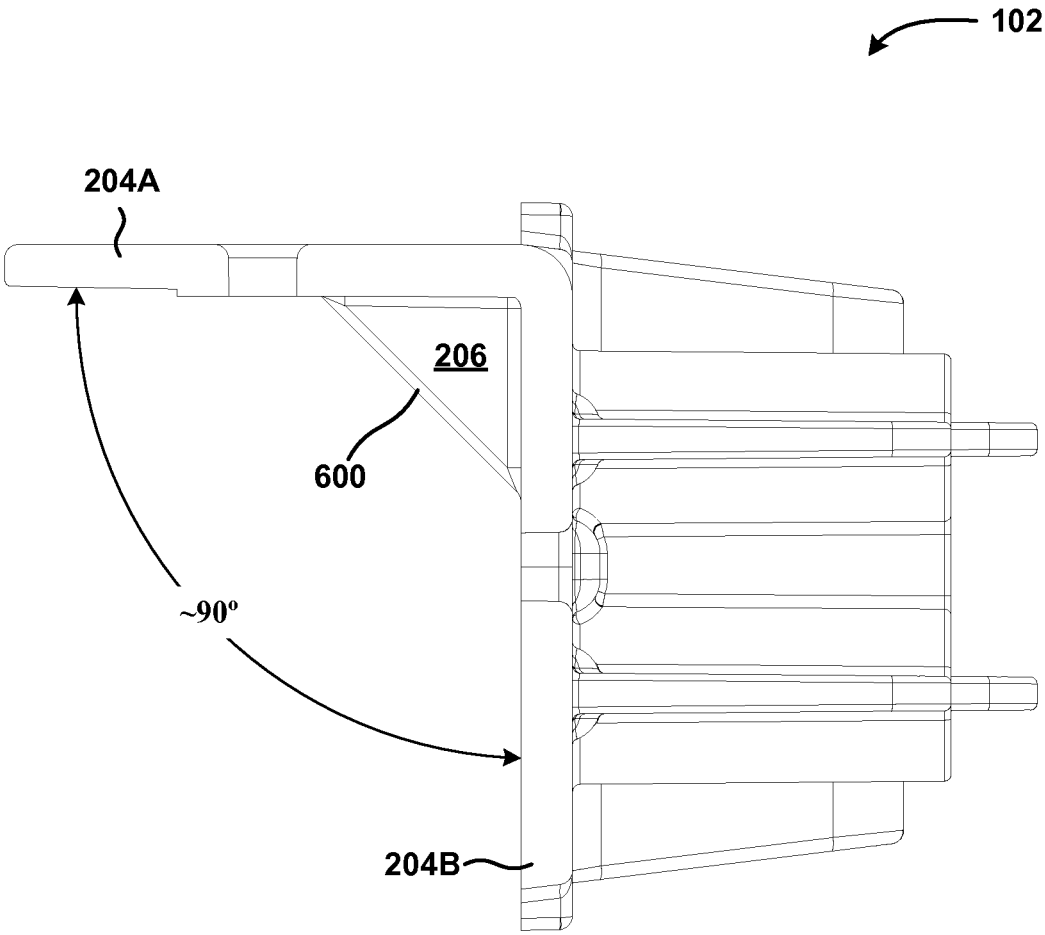
FIG. 6 is top elevation view of the main hanger portion of the deck drainage system bracket, according to an illustrative embodiment.

FIG. 6 is a top view of the main hanger portion 102. As shown in FIG. 6, the mounting surfaces 204 can be offset by about a ninety degree angle of rotation, if desired. The mounting surfaces 204 also can be supported by one or more of the supports 206. As explained above, additional or alternative mounting surfaces 204 and/or supports 206 can be included, if desired. In one contemplated embodiment, a third mounting surface 204C (not shown in FIG. 6) can be included and can be arranged between the first mounting surface 204A and the second mounting surface 204B. In the contemplated embodiment, the surface of the third mounting surface 204C is arranged in a configuration similar to the configuration of the edge 600 of the support 206. Thus, the third mounting surface 204C, if included, can be arranged at approximately a forty-five degree offset, relative to the mounting surfaces 204A, 204B shown in FIG. 6. It should be understood that this embodiment is illustrative, and should not be construed as being limiting in any way.

Figure 7:
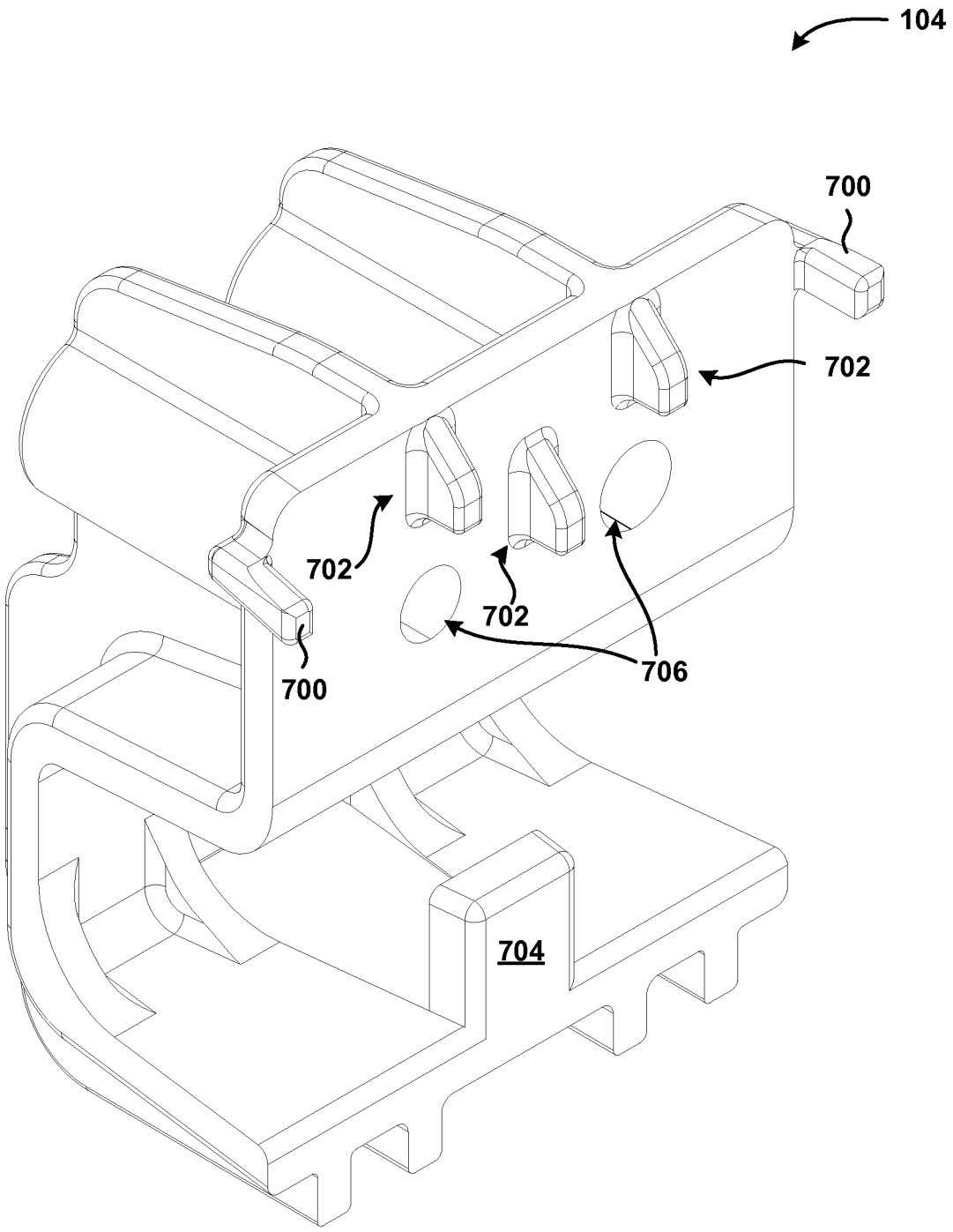
FIG. 7 is a perspective view of a hanger swing portion of the deck drainage system bracket, according to an illustrative embodiment.

Turning now to FIG. 7, aspects of the hanger swing portion 104 are described in additional detail. As mentioned above, the hanger swing portion 104 can include one or more hangers 700. The hangers 700 can include protrusions shaped as rods or hooks. In some embodiments, the hangers 700 illustrated in FIG. 7 include a hook-shaped end configured to engage the hanger guides 200 on two surfaces. In these and other embodiments, the hangers 700 cooperate with the hanger guides 220 of the main hanger portion 102 to support the hanger swing portion 104 in a pre-assembled or assembled configuration.

In some embodiments, an installer can pre-assemble the deck drainage system bracket 100 before or during installation, with the main hanger portion 102 supporting the hanger swing portion 104 via the hanger guides 220 and the hangers 700. As can be more easily seen in FIG. 8 described below, the hangers 700 can be angled to encourage the hanger swing portion 104 to engage the main hanger portion 102 after being pre-assembled and/or assembled together. Thus, an installer can be freed from having to hold the main hanger portion 102 and the hanger swing portion 104 with two hands and instead can free one hand for other operations during installation of the deck drainage system bracket 100 and/or a drainage system by using the hangers 700 and the hanger guides 220 of the deck drainage system bracket 100. Because the hangers 700 can be varied in terms of length, numbers, configurations, orientations, and the like, it should be understood that the embodiment of FIG. 7 is illustrative, and should not be construed as being limiting in any way.

The hanger swing portion 104 also can include one or more notches 702. As described above, the notches 702 can interface with the notch recesses 210 of the main hanger portion 102 for various purposes. For example, the notches 702 can transfer weight from the hanger swing portion 104 to the main hanger portion 102. The notches 702 also can be used to restrict rotation of the hanger swing portion 104 relative to the main hanger portion 102. Furthermore, notches 702 can interface with the notch recesses 210 to add additional interface points between the main hanger portion 102 and the hanger swing portion 104 thereby strengthening and/or encouraging proper assembly of the deck drainage system bracket 100. It should be understood that these embodiments are illustrative, and should not be construed as being limiting in any way.

As can be appreciated from FIGS. 1-6, the main hanger portion 102 and the notch recesses 210 of the main hanger portion 102 can be located substantially in-line with the mounting surfaces 204 of the main hanger portion 102. Thus, the notches 702 can transfer weight from the hanger swing portion 104, which may be out of line with the mounting surfaces 204, to the notch recess 210. As such, the notches 702 and the notch recesses 210 can cooperate to transfer weight to the main hanger portion 102, thereby increasing the strength of the deck drainage system bracket 100. As explained above, the ribs 218 of the deck drainage system bracket 100 can be included to further facilitate weight and/or force transfers through the various components of the deck drainage system bracket 100. As explained above, the notches 702 can be varied in terms of numbers, orientations, configurations, locations, and the like. As such, the illustrated embodiments should be understood as being illustrative and should not be construed as being limiting in any way.

The hanger swing portion 104 also can include a tab 704. The tab 704 can be, but is not necessarily, similar to the tab 214 described above with regard to the main hanger portion 102. Thus, it can be appreciated that the size, orientation, and configuration of the tab 704 can be similarly varied as described above. The tab 704 also can cooperate with the tab 214 to support a standing seam or other portion of a drainage system. Thus, the deck drainage system bracket 100 can provide a rigid and/or strong support mechanism for the drainage system, as can be appreciated in more detail with reference to FIGS. 12-13.

The hanger swing portion 104 also can include assembly through holes ("assembly holes") 706. The assembly holes 706 can be, but are not necessarily, similar or even identical to the assembly holes 212 described above with respect to the main hanger portion 102. Thus, it can be appreciated that the fasteners 106 described above with reference to FIG. 1 can, but do not necessarily, pass through one or more of the assembly holes 706. It should be understood that the illustrated embodiment of the hanger swing portion 104 is illustrative, and should not be construed as being limiting in any way.

Figure 8:
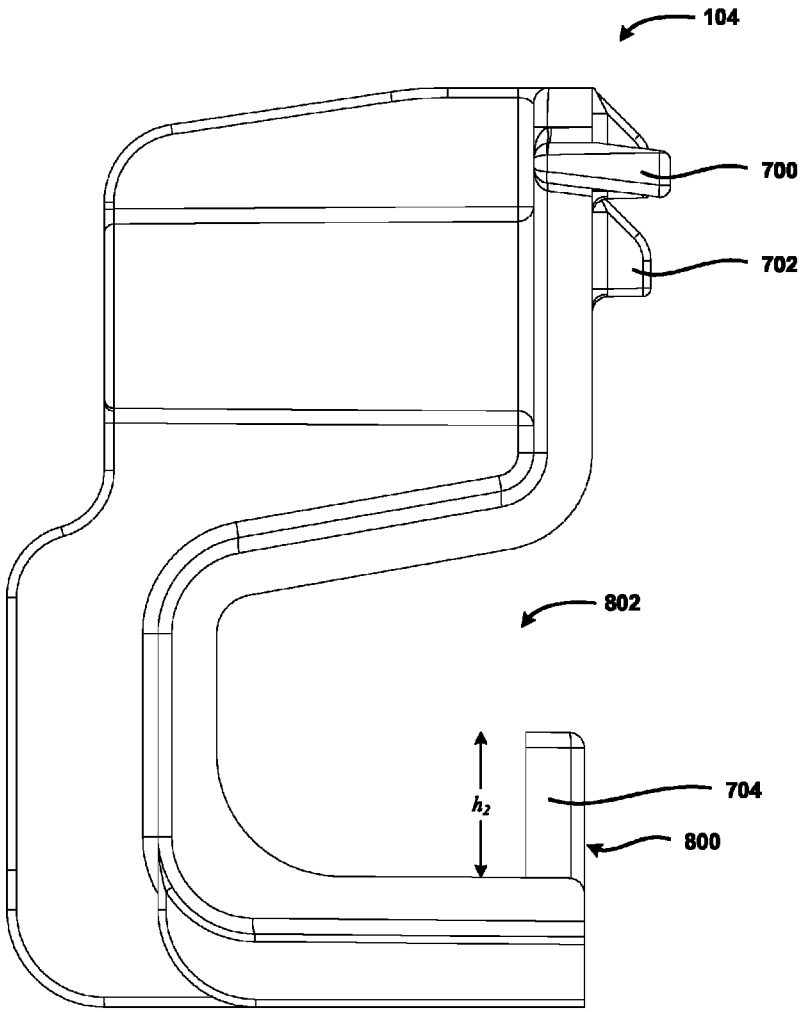
FIG. 8 is a side elevation view of the hanger swing portion of the deck drainage system bracket, according to an illustrative embodiment.
Figure 9:
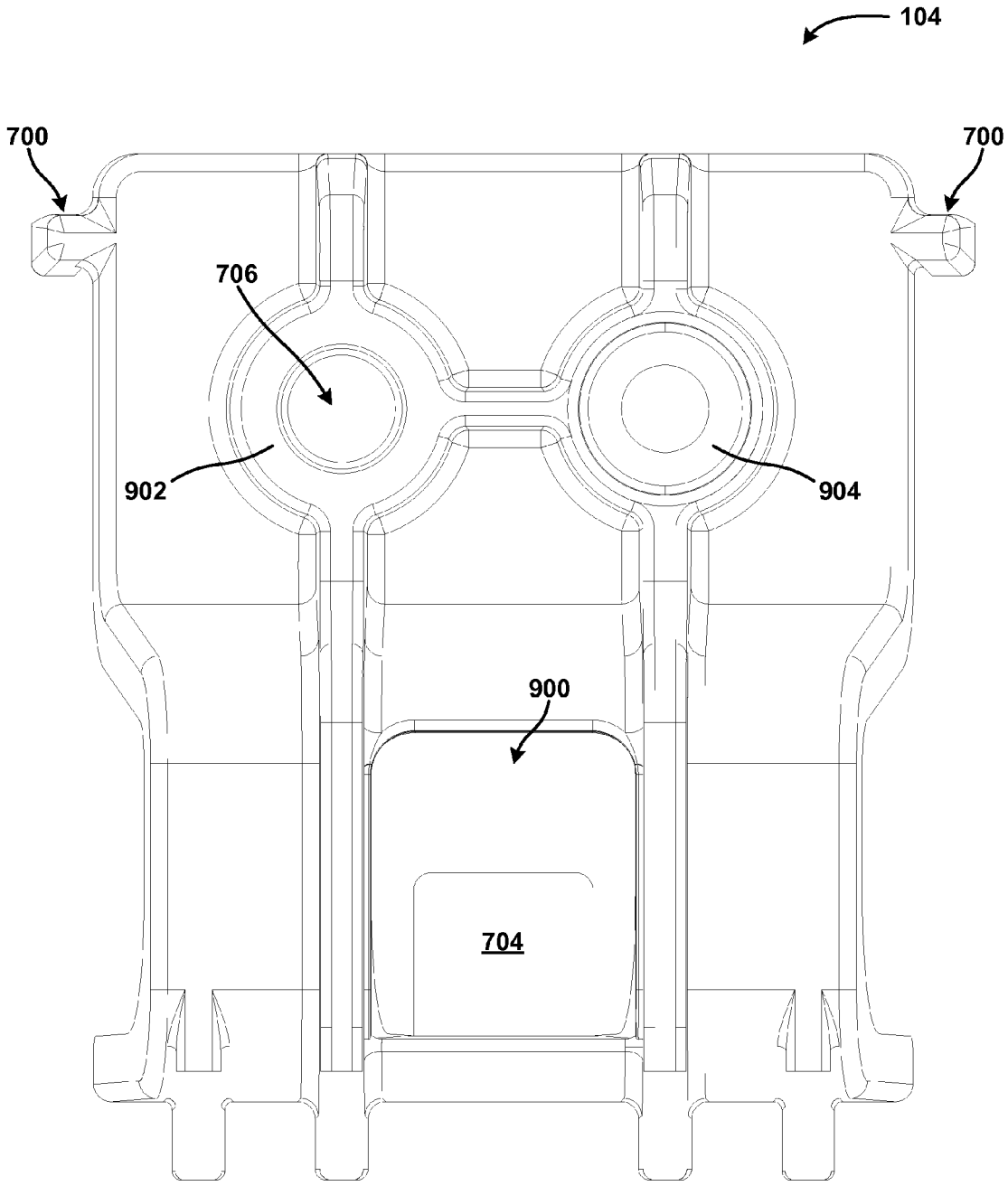
FIG. 9 is a rear elevation view of the hanger swing portion of the deck drainage system bracket, according to an illustrative embodiment.
Figure 10:
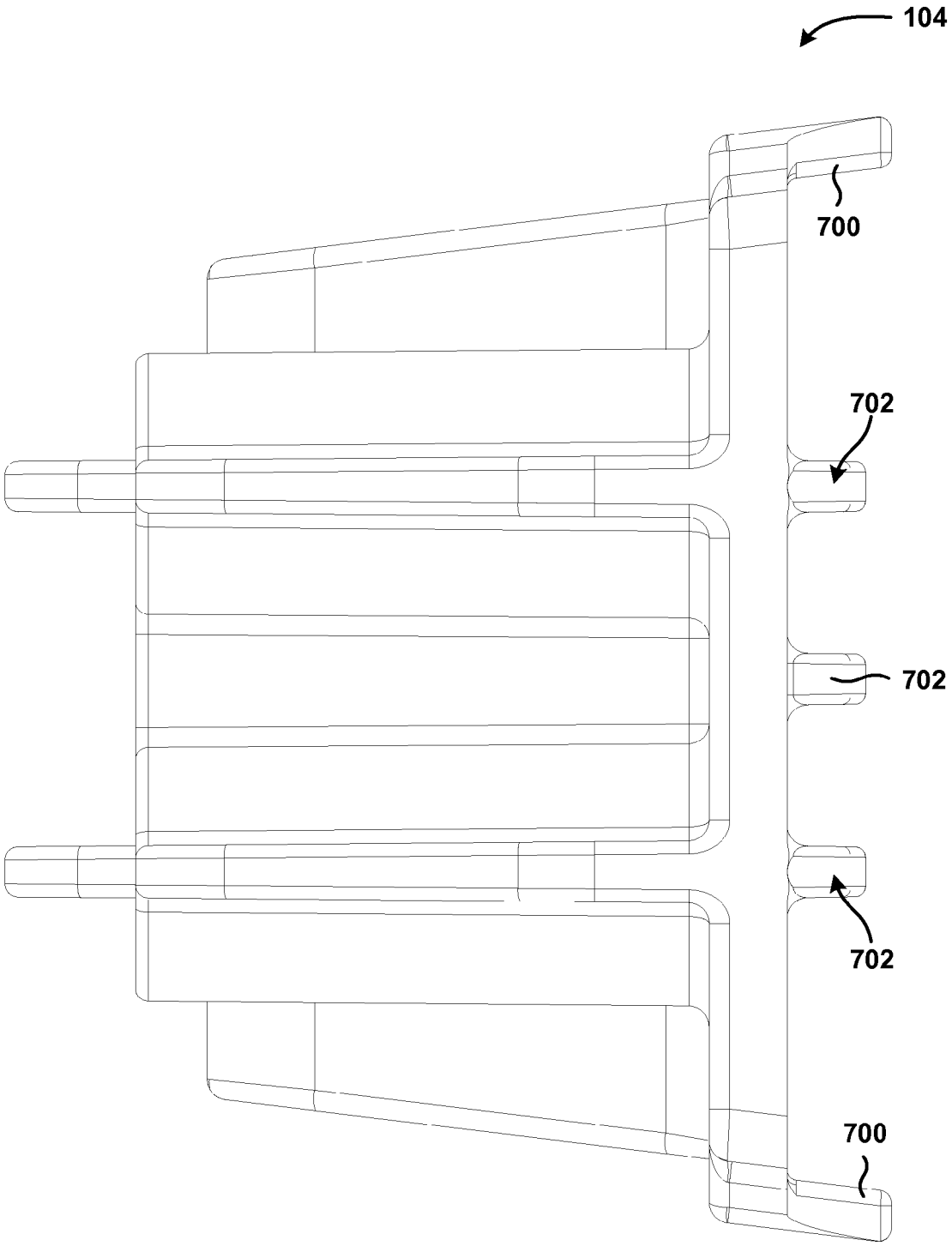
FIG. 10 is top elevation view of the hanger swing portion of the deck drainage system bracket, according to an illustrative embodiment.

Referring now to FIGS. 8-10, arrangements of various structures of the deck drainage system bracket 100 can be more clearly understood. With reference to FIG. 8, it can be appreciated that a contact surface 800 of the tab 704 can be substantially parallel to a contact surface 300 of the tab 214 of the main hanger portion 102. As explained above, however, the contact surface 800 and/or the tab 704 can be tilted away from or toward an opening 802 of the hanger swing portion 104. Similarly, it should be understood that the profile, orientation, and relative size of the tab 704 can be varied, depending upon various considerations. For example, the height $h_2$ of the tab 704 can be varied to accommodate various sizes and configurations of drainage panels and/or to match or substantially match a size, configuration, and/or orientation of the tab 214 of the main hanger portion 102. Similarly, a relative size and configuration of the opening 802 for accommodating the drainage panels can be varied by varying various orientations, sizes, configurations, and/or other aspects of the hanger swing portion 104. As such, the illustrated embodiment should be understood as being illustrative and should not be construed as being limiting in any way.

As can be most easily seen in FIG. 9, the hanger swing portion 104 also can include an aperture 900. The aperture 900 can be, but is not necessarily, similar or even identical to the aperture 400 described above with reference to the main hanger portion 102. Similarly, the hanger swing portion 104 can include a lip 902 and/or a fastener support surface 904 that can be, but are not necessarily, similar or identical to the lip 502 and the fastener support surface 504 discussed above with reference to FIG. 5. FIG. 10 shows a top view of the hanger swing portion 104, according to one embodiment. In FIG. 10, the relative locations, sizes, and orientations of the hangers 700 and the notches 702 can be easily seen. It should be understood that the embodiment illustrated in FIG. 10 is illustrative and should not be construed as being limiting in any way.

Figure 11:
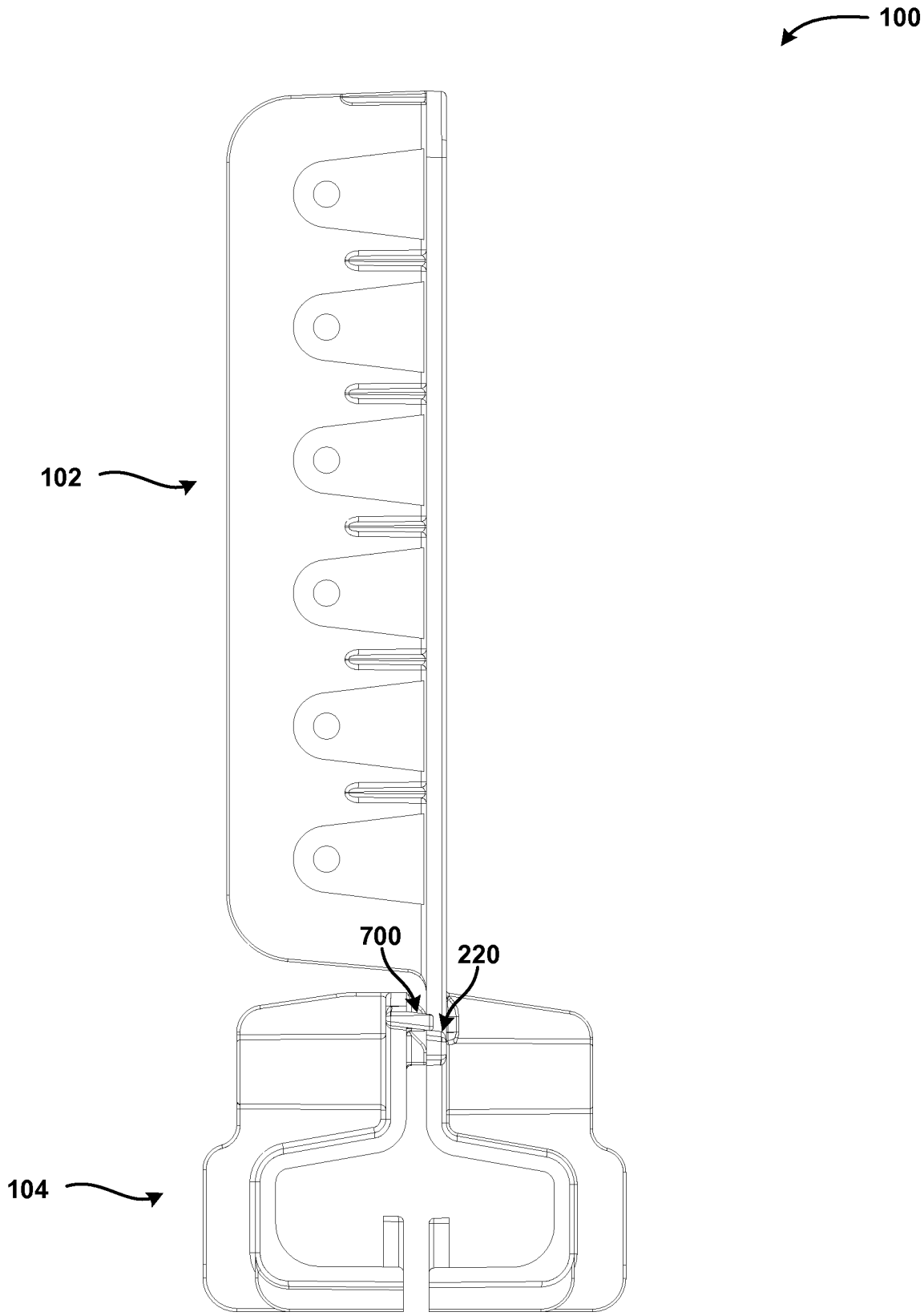
FIG. 11 illustrates a pre-assembly of the deck drainage system bracket, according to an illustrative embodiment.

Turning now to FIG. 11, pre-assembly and/or assembly of the deck drainage system bracket 100 is illustrated, according to an illustrative embodiment. As shown in FIG. 11, the main hanger portion 102 and the hanger swing portion 104 can be pre-assembled or assembled by "hanging" the hanger swing portion 104 on the main hanger portion 102 via the hangers 700 and the hanger guides 220. Although not shown in FIG. 11, a bolt, screw, nail, or other fastener 106 can be inserted through the fastener recess 110, the insert recess 112, the insert 108 and the assembly holes 212, 706. In some embodiments, one or more of the fastener recesses 110, one or more of the insert recesses 112, and one or more of the assembly holes 212, 706 can collectively constitute a passageway for the fastener 106. As such, the deck drainage system bracket 100 can be pre-assembled and/or mounted and assembled during installation using the hangers 700 and the hanger guides 220. Based upon the above description of the various variations of the hangers 700 and the hanger guides 220, it should be understood that the embodiment shown in FIG. 11 is illustrative, and should not be construed as being limiting in any way.

Turning now to FIGS. 12-13, example implementations of the deck drainage system bracket 100 in a deck drainage system are illustrated, according to illustrative embodiments. As shown, the deck drainage system bracket 100 can be used to support one or more drainage panels 1200A-B (hereinafter collectively and/or generically referred to as "drainage panels 1200"). While only a profile view of the drainage panels 1200 are shown in FIGS. 12-13, it should be understood that a length of the drainage panels 1200 can be varied for various purposes and/or based upon a number of design, manufacturing, and/or installation considerations.

According to some embodiments, the drainage panels 1200 can be coupled together along respective lengths of the drainage panels 1200. The drainage panels 1200 can be coupled and/or joined together using various mechanisms and/or fasteners such as, for example, screws, rivets, bolts, nails, glue or other adhesives, spot welding or other thermal bonding mechanisms, and/or other thermal, mechanical, and/or chemical adhesives and/or fasteners. In the illustrated embodiment, the drainage panels 1200 are joined together by cooperatively assembling to form a standing seam (illustrated generally at 1202). It should be understood that this embodiment is illustrative, and should not be construed as being limiting in any way.

The standing seam 1202 shown in FIG. 12 can be formed by various folds of the drainage panels 1200. In the illustrated embodiment, the drainage panel 1200B is folded to form an elbow or right angle bend 1204. The drainage panel 1200A is folded to provide a cover 1206 on top of the right angle bend 1204. It can be appreciated that the standing seam 1202 can be sealed by assembling the main hanger portion 102 to the hanger swing portion 104 via tightening of the fastener 106 or via other mechanisms and/or processes. Thus, the standing seam 1202 can provide a strong connection that can be supported by the deck drainage system bracket 100. The standing seam 1202 shown in FIG. 12 also can provide leakage protection for the deck drainage system. In particular, water or other liquids disposed at a top side 1208 of the drainage panels 1200 can be prevented or encumbered by the standing seam 1202 from leaking through to a bottom side 1210 of the drainage system. It should be understood that the illustrated embodiment is illustrative, and should not be construed as being limiting in any way.

FIG. 13 illustrates another embodiment of an implementation of the deck drainage system bracket 100. In FIG. 13, an alternative embodiment of the standing seam 1300 is shown and can be provided by the drainage panels 1200. Because various folds and/or configurations of the drainage panels 1200 are possible, it should be understood that various standing seams in addition to, or instead of, the illustrated standing seams 1202, 1300 are possible. As such, the illustrated standing seams 1202, 1300 should be understood as being illustrative and should not be construed as being limiting in any way.

While various structures of the deck drainage system bracket 100 have been described herein, some dimensions are now provided as an example of one contemplated embodiment. This embodiment is illustrative and should not be construed as being limiting in any way. With reference to FIG. 3, some example dimensions are now described. In one example embodiment, the main hanger portion 102 measures about 9.180 inches from top to bottom. The top mounting hole 206 can be placed about 0.776 inches from the top surface of the main hanger portion 102 and the other mounting holes 206 can be located one inch apart, on-center, from the first mounting hole 206. According to various embodiments, a distance from the bottom of the main hanger portion 102 to the top of the tab 214 can range from about 0.364 inches to about 0.604 inches, and the tab 214 is about 0.050 inches thick and the lower portion 202 can measure about 1.500 inches from the support surface 300 to the back of the lower portion 202. It should be understood that these embodiments are illustrative, and should not be construed as being limiting in any way.

According to some embodiments, the fastener recess 110 has a first diameter of 0.297 inches that narrows to 0.277 inches to provide the fastener support structure 504 shown in FIG. 5. Similarly, the insert recess 112 can have an inner diameter of about 0.201 inches or other sizes. In some embodiments, as mentioned above, the inserts 108 used are 6041-3BR 375 and therefore the size of the insert recess 112 can be sized accordingly. According to various embodiments, the hangers 700 can extend from about 0.200 inches to about 0.350 inches past the front of the hanger swing portion 104. It should be understood that these embodiments are illustrative, and should not be construed as being limiting in any way. These and other dimensions of the deck drainage system bracket 100 can be configured according to various considerations and therefore are provided only as an example of one implementation. As such, this embodiment is illustrative and should not be construed as being limiting in any way.

Based on the foregoing, it should be appreciated that various embodiments of deck drainage system brackets have been disclosed herein. Although the subject matter presented herein has been described in conjunction with one or more particular embodiments and implementations, it is to be understood that the embodiments defined in the appended claims are not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the embodiments, which is set forth in the following claims.

I claim:

1. A deck drainage system bracket comprising:

a hanger swing portion comprising a first hanger comprising a first protrusion extending from a first side of the hanger swing portion, the first hanger being configured to at least partially support the hanger swing portion during assembly of the deck drainage system bracket, a second hanger comprising a second protrusion extending from a second side of the hanger swing portion, the second hanger being configured to at least partially support the hanger swing portion during assembly of the deck drainage system bracket, a first tab configured to engage at least a portion of a deck drainage panel to support the deck drainage panel, three notches comprising further protrusions extending from the hanger swing portion, the three notches being located between the first hanger and the second hanger, and a first assembly hole located between the first hanger and the second hanger, a fastener recess located between the first hanger and the second hanger and being configured to house a portion of a fastener, and an insert recess located between the first hanger and the second hanger and being configured to house a portion of an insert configured to engage a portion of a further fastener; and a main hanger portion comprising a first hanger guide located at a first side of the main hanger portion, the first hanger guide for engaging the first hanger of the hanger swing portion to at least partially support the hanger swing portion, a second hanger guide located at a second side of the main hanger portion, the second hanger guide for engaging the second hanger of the hanger swing portion to at least partially support the hanger swing portion, a mounting surface comprising a plurality of mounting holes for mounting the deck drainage system bracket to a support surface, a second assembly hole located between the first hanger guide and the second hanger guide that cooperates with the first assembly hole to form an assembly passageway through which at least a portion of the fastener or the further fastener passes, three notch recesses formed in the main hanger portion between the first hanger guide and the second hanger guide, each of the three notch recesses configured to engage a respective one of the three notches, and a second tab configured to engage at least a portion of a further deck drainage panel to support the further deck drainage panel.

2. The deck drainage system bracket of claim 1, wherein the fastener comprises a bolt, and wherein the bolt is passed through the first assembly hole and the second assembly hole.

3. The deck drainage system bracket of claim 2, further comprising a first insert recess formed in the main hanger portion or a second insert recess formed in the hanger swing portion.

4. The deck drainage system bracket of claim 1, wherein at least a portion of the main hanger portion is formed from glass-filled NYLON, and wherein at least a portion of the hanger swing portion is formed from glass-filled NYLON.

5. The deck drainage system bracket of claim 1, further comprising a second mounting surface, wherein each of the mounting surface and the second mounting surface comprises a plurality of mounting holes.

6. The deck drainage system bracket of claim 1, wherein the first tab is located proximate to a third side of the hanger swing portion, wherein the hanger swing portion comprises a first aperture configured to allow visual access to the first tab from a fourth side of the hanger swing portion, wherein the second tab is located proximate to a third side of the main hanger portion, and wherein the main hanger portion comprises a second aperture configured to allow visual access to the second tab from a fourth side of the main hanger portion.

7. The deck drainage system of claim 5, further comprising a plurality of supports extending from at least a portion of a first of the two mounting surfaces to at least a portion of a second of the two mounting surfaces.

8. A deck drainage system bracket comprising:

a hanger swing portion comprising a plurality of hangers, each of the plurality of hangers comprising protrusions extending from the hanger swing portion and configured to support the hanger swing portion during assembly of the deck drainage system bracket, the plurality of hangers comprising a first hanger comprising a first protrusion extending from a first side of the hanger swing portion and being configured to guide the hanger swing portion and to support the hanger swing portion, and a second hanger comprising a second protrusion extending from a second side of the hanger swing portion and being configured to guide the hanger swing portion and to support the hanger swing portion, a first tab configured to engage at least a portion of a deck drainage panel to support the deck drainage panel, three notches comprising further protrusions extending from the hanger swing portion, the three notches being located between the first hanger and the second hanger, a first pair of assembly holes located between the first hanger and the second hanger, a fastener recess located between the first hanger and the second hanger, the fastener recess being configured to house a portion of a fastener, and an insert recess located between the first hanger and the second hanger, the insert recess housing that houses at least a portion of an insert configured to engage a portion of a further fastener; and a main hanger portion comprising a first hanger guide for engaging and guiding the first hanger of the hanger swing portion to support the hanger swing portion, a second hanger guide for engaging and guiding the second hanger of the hanger swing portion to support the hanger swing portion, a first mounting surface and a second mounting surface, each of the first mounting surface and the second mounting surface comprising a plurality of mounting holes for mounting the deck drainage system bracket to a support surface, a second pair of assembly holes located between the first hanger guide and the second hanger guide, the second pair of assembly holes being configured to cooperate with the first pair of assembly holes to provide a pair of assembly passageways, three notch recesses formed in the main hanger portion between the first hanger guide and the second hanger guide, each of the three notch recesses configured to engage a respective one of the three notches, and a second tab configured to engage at least a portion of a further deck drainage panel to support the further deck drainage panel.

9. The deck drainage system bracket of claim 8, further comprising a fastening mechanism passed through a of the pair of assembly passageways and into the insert.

10. The deck drainage system bracket of claim 8, wherein at least a portion of the main hanger portion is formed from glass-filled NYLON, and wherein at least a portion of the hanger swing portion is formed from glass-filled NYLON.

11. The deck drainage system bracket of claim 8, wherein the first tab is located proximate to a third side of the hanger swing portion, wherein the hanger swing portion comprises a first aperture configured to allow visual access to the first tab from a fourth side of the hanger swing portion, wherein the second tab is located proximate to a third side of the main hanger portion, and wherein the main hanger portion comprises a second aperture configured to allow visual access to the second tab from a fourth side of the main hanger portion.

12. The deck drainage system of claim 8, further comprising:

a plurality of supports extending from at least a portion of the first mounting surface to at least a portion of the second mounting surface; and at least one rib for supporting at least a portion of the main hanger portion.

13. A deck drainage system bracket comprising:

a hanger swing portion comprising a first hanger comprising a first protrusion extending from a first side of the hanger swing portion and being configured to guide the hanger swing portion and to support the hanger swing portion, a second hanger comprising a second protrusion extending from a second side of two hangers, each of the hangers comprising protrusions extending from the hanger swing portion and being configured to guide the hanger swing portion and to support the hanger swing portion, a first tab that engages at least a portion of a deck drainage panel to support the deck drainage panel, three notches comprising further protrusions extending from the hanger swing portion, the three notches being located between the first hanger and the second hanger, a first pair of assembly holes located between the first hanger and the second hanger, a fastener recess located between the first hanger and the second hanger, the fastener recess being configured to house a portion of a fastener, and an insert recess located between the first hanger and the second hanger, the insert recess housing that houses a portion of an insert configured to engage a portion of a further fastener;

a main hanger portion comprising a first mounting surface comprising a plurality of mounting holes for mounting the deck drainage system bracket to a support surface, a second mounting surface comprising a further plurality of mounting holes for mounting the deck drainage system bracket to the support surface, the second mounting surface being at least partially connected to the first mounting surface, a second tab for engaging at least a portion of a further deck drainage panel and for supporting the further deck drainage portion, a first hanger guide for engaging and guiding the first hanger of the hanger swing portion to support the hanger swing portion, a second hanger guide for engaging the second hanger of the hanger swing portion, to support the hanger swing portion, a second pair of assembly holes located between the first hanger guide and the second hanger guide, the second pair of assembly holes configured to cooperate with the first pair of assembly holes to provide a pair of assembly passageways, and three notch recesses formed in the main hanger portion between the first hanger guide and the second hanger guide, each of the three notch recesses configured to engage a respective one of the three notches, wherein each of the first mounting surface and the second mounting surface comprises a plurality of mounting holes for mounting the deck drainage system bracket to a support surface of a deck; and a fastening mechanism that passes through at least one of the pair of assembly passageways and engages the insert, the at least one of the pair of assembly passageways comprising one of the first pair of assembly holes and one of the second pair of assembly holes.

14. The deck drainage system bracket of claim 13, wherein at least a portion of the main hanger portion is formed from glass-filled NYLON, and wherein at least a portion of the hanger swing portion is formed from glass-filled NYLON.

15. The deck drainage system bracket of claim 13, wherein the first tab is located proximate to a third side of the hanger swing portion, wherein the hanger swing portion comprises a centrally located first aperture formed in a second side of the hanger swing portion, the first aperture allowing visual access to the first tab from the third side of the hanger swing portion, wherein the second tab is located proximate to a third side of the main hanger portion, and wherein the main hanger portion comprises a second aperture formed in a second side of the main hanger portion, the second aperture allowing visual access to the second tab from the third side of the main hanger portion.

16. The deck drainage system of claim 13, further comprising:

a plurality of supports extending from at least a portion of the first mounting surface to at least a portion of the second mounting surface; and a plurality of ribs on the main hanger portion and the hanger swing portion for supporting at least a portion of the main hanger portion or the hanger swing portion.

* * * * *